US005737840A

United States Patent [19]

Akachi

[11] Patent Number: 5,737,840

[45] Date of Patent: Apr. 14, 1998

[54] METHOD OF MANUFACTURING TUNNEL-PLATE TYPE HEAT PIPES

[75] Inventor: Hisateru Akachi, 6-5-603, Kamitsuruma 5-chome, Sagamihara-shi, Kanagawa 228, Japan

[73] Assignees: Actronics Kabushiki Kaisha, Isehara; Hisateru Akachi, Sagamihara, both of Japan

[21] Appl. No.: 678,525

[22] Filed: Jul. 9, 1996

[30] Foreign Application Priority Data

Jul. 14, 1995 [JP] Japan ..... 7-208966
Aug. 9, 1995 [JP] Japan ..... 7-233151

[51] Int. Cl.[6] ..... B23P 15/00

[52] U.S. Cl. ..... 29/890.032; 29/890.03

[58] Field of Search ..... 29/890.032, 890.03; 165/104.26

[56] References Cited

U.S. PATENT DOCUMENTS

| | | | |
|---|---|---|---|
| 4,245,380 | 1/1981 | Maxson | 29/890.032 |
| 4,660,625 | 4/1987 | Musinski | 29/890.032 |
| 4,921,041 | 5/1990 | Akachi | 165/104.29 |
| 5,029,389 | 7/1991 | Tanzer | 164/104.26 |
| 5,219,020 | 6/1993 | Akachi | 165/104.26 |
| 5,454,163 | 10/1995 | McDonald et al. | 29/890.032 |
| 5,598,632 | 2/1997 | Camarda et al. | 29/890.032 |

*Primary Examiner*—Irene Cuda

*Attorney, Agent, or Firm*—Foley & Lardner

[57] ABSTRACT

A tunnel-plate type heat pipe is manufactured out of a tube having capillary parallel tunnels defined by partitions through shaping both ends of the tube, forming recesses in the partitions in the vicinity of each end of the tube, closing both ends of the tube to form a capillary tunnel container, cleaning the capillary tunnel container, and charging the capillary tunnel container with a predetermined amount of working fluid.

30 Claims, 7 Drawing Sheets

METHOD OF MANUFACTURING TUNNEL-PLATE TYPE HEAT PIPES

BACKGROUND OF THE INVENTION

The present invention relates generally to a method of manufacturing heat pipes and more particularly, to a method of manufacturing tunnel-plate type heat pipes having a capillary tunnel container therein.

Contrary to heat pipes applying a phase change of bi-phase condensative working fluid, serpentine capillary heat pipes are constructed so that working fluid is always dispersed in a capillary tube due to its surface tension, i.e. liquid droplets and vapor bubbles are alternately disposed throughout the capillary tube. The liquid droplets and vapor bubbles are axially vibrated by pressure wave due to nuclear boiling of working fluid in a heat receiving portion of the heat pipe, which serves to transport heat from a high temperature portion of the heat pipe to a low temperature portion thereof. Such serpentine capillary heat pipes are disclosed, e.g. in U.S. Pat. No. 4,921,041 to Akachi, and U.S. Pat. No. 5,219,020 to Akachi, the teachings of which are incorporated herein for reference. The features of the serpentine capillary heat pipes are excellent heat transport characteristic even in a top heat mode, which is impossible with ordinary heat pipes, possible easy bending, possible reduction in thickness and weight, and possible reduction in volume due to no need of fins mounted.

One of the most important points of the structure of the serpentine capillary heat pipes is to construct the capillary tube having an inner diameter which is small enough to allow working fluid to be always dispersed in the capillary tube due to its surface tension, i.e. to allow liquid droplets and vapor bubbles to alternately be disposed throughout the capillary tube. Another is to construct the capillary tube to wind between high and low temperature areas, i.e. to have a large number of working fluid evaporating and condensing portions. The greater is the number of turns of the serpentine capillary heat pipe, the less is the dependency of the performance of the serpentine capillary heat pipe on the gravity, which ensures excellent characteristic of the serpentine capillary pipe.

When manufacturing the serpentine capillary heat pipes, the capillary tube is formed first. Specifically, at a first process of casting, an ingot or a bullet is formed. At a second process of extrusion molding, a large-diameter hollow tube is formed by press extrusion molding. At a third process of elongation, the large-diameter hollow tube is reduced in diameter. This process is carried out by drawing using dice for defining the outer diameter of the tube and plugs for defining the inner diameter thereof. Several tens of processes of drawing using the dice and plugs are needed to obtain required capillary tube. The capillary tube obtained in such a way are shaped like a snake by a bending machine, obtaining the serpentine capillary heat pipe which will be a finished product through an end closing process, a high-vacuum deaerating process, and a working fluid charging process.

On the other hand, the most advanced application of the serpentine capillary heat pipes is seen in U.S. patent application Ser. No. 08/351,217 filed Dec. 2, 1994. This document discloses a tunnel-plate type heat pipe comprising a first metallic plate having one side formed with a groove which forms a continuous channel therein and has a predetermined number of turnings and a predetermined number of portions arranged in parallel with each other, and a second metallic plate disposed on one side of the first plate wherein the second plate closes the channel such that the groove of the first plate serves as a tunnel to be charged with a predetermined amount of working fluid. Thus, with reduced thickness and weight, the tunnel-plate type heat pipe enables effective heat diffusion and transport.

According to a method of manufacturing the tunnel-plate type heat pipes, at a first process of machining, a plate of metallic material such as pure copper, aluminum or the like is machined. At a second process of groove formation, a serpentine groove having a predetermined width and depth is formed in one side of the plate by machining or photo-etching. At a third process of laminating, another plate with no groove is placed on and joined to the plate with the serpentine groove on the one side thereof to obtain a laminated plate having a serpentine capillary tunnel container therein. This process needs a high and particular technology due to application of high temperature and pressure. At a fourth process of deaeration and charging, the serpentine capillary tunnel container is deaerated in the high-vacuum state, then charged with a predetermined amount of working fluid, obtaining the tunnel-plate type heat pipe.

The serpentine capillary heat pipes have excellent features as described above, but with increased manufacturing cost. Specifically, formation of the capillary tube needs a lot of manufacturing processes and time. Moreover, for presenting the high performance, the serpentine capillary heat pipes need a large number of turns, which is difficult to be arranged through an automation.

On the other hand, the tunnel-plate type heat pipes need a highly advanced technology of forming a serpentine groove in one side of the plate and laminating a plurality of plates, causing a large increase in manufacturing cost, which may result in their difficult application to the devices other than the high-grade devices.

It is, therefore, an object of the present invention to provide a method of manufacturing tunnel-plate type heat pipes which enables a reduction in manufacturing cost in preserving the excellent features of the serpentine capillary heat pipes.

SUMMARY OF THE INVENTION

According to one aspect of the present invention, there is provided a method of manufacturing a heat pipe out of a tube having capillary parallel tunnels defined by partitions, comprising the steps of:

shaping ends of the tube;

forming recesses in the partitions in the vicinity of each of said ends of the tube;

closing said ends of the tube to form a capillary tunnel container;

cleaning said capillary tunnel container; and charging said capillary tunnel container with a predetermined amount of a predetermined working fluid.

Another aspect of the present invention lies in providing a method of manufacturing a heat pipe out of a tube having capillary parallel tunnels defined by partitions, comprising the steps of:

shaping ends of the tube;

forming recesses in the partitions in the vicinity of each of said ends of the tube, said forming step including forming first holes from a surface of the tube, said first holes having the diameter smaller than twice the diameter of the capillary parallel tunnels, and closing openings of said first holes;

closing said ends of the tube to form a capillary tunnel container;

cleaning said capillary tunnel container; and charging said capillary tunnel container with a predetermined amount of a predetermined working fluid.

The other aspect of the present invention lies in providing a method of manufacturing a heat pipe out of a tube having capillary parallel tunnels defined by partitions, comprising the steps of:

shaping ends of the tube;

forming recesses in the partitions in the vicinity of each of said ends of the tube;

crushing end portions of the tube;

closing said ends of the tube to form a capillary tunnel container;

cleaning said capillary tunnel container; and charging said capillary tunnel container with a predetermined amount of a predetermined working fluid.

DETAILED DESCRIPTION OF THE INVENTION

Figure 1:
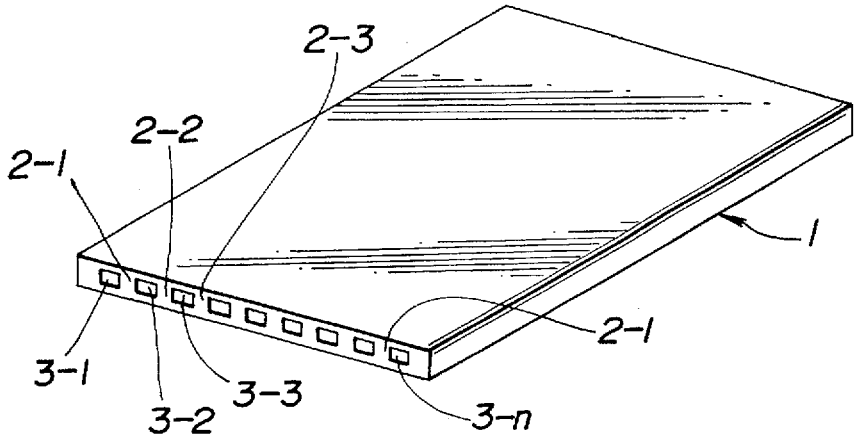
FIG. 1 is a perspective view showing a ribbon-like tube after completing the first process according to a first preferred embodiment of the present invention.

A progress in the art of press extrusion molding is remarkable in recent years. Particularly, the art of press extrusion molding of light and soft metals such as aluminum and magnesium enables manufacturing of ribbon-like tubes having a plurality of capillary parallel tunnels formed longitudinally. The diameter of the capillary parallel tunnels can be reduced to 0.9 mm or less, which enables, e.g. the ribbon-like tubes having the width of 20 mm or less and the thickness of 1.3 mm or less to be formed with 20 capillary parallel tunnels. Moreover, the length of the ribbon-like tubes can be several hundreds meters. Due to their material of light metal and small thickness, the ribbon-like tubes have an excellent flexibility, enabling their application in the bent form.

If both ends of the ribbon-like tube can be closed and shaped so that the capillary parallel tunnels communicate with each other at both ends thereof to form a continuous serpentine capillary tunnel container, ribbon-like tunnel-plate type heat pipes will be obtained. When formed like a long serpentine, these heat pipes are usable in the same way as the serpentine capillary heat pipes, whereas when arranged parallel to each other, they are usable in the same way as the tunnel-plate type heat pipe as disclosed in U.S. patent application Ser. No. 08/352,217.

A first fundamental method of manufacturing the ribbon-like tunnel-plate type heat pipes includes five processes: the first process wherein both ends of the ribbon-like tube having a plurality of capillary parallel tunnels are machined in a predetermined form; the second process wherein holes having the diameter smaller than twice the diameter of the capillary parallel tunnel are formed from a surface of the ribbon-like tube in respective positions slightly distant from respective ends thereof according to a machining method producing no fin such as electric discharge machining, ultrasonic machining, laser machining or the like, by which each partition between the capillary parallel tunnels is partly eliminated to ensure mutual communication of the capillary parallel tunnels at both ends thereof; the third process wherein the capillary parallel tunnels are cleaned to remove dirt and chip due to the above machining and perforating; the fourth process wherein openings of the holes are closed by welding or soldering of a thin light-metal member after providing thereto opening reducing means which apply compression of the surface of the ribbon-like tube, or filling means with a predetermined material; and the fifth process wherein both ends of the ribbon-like tube are closed by welding or compression so that the capillary parallel tunnels form a capillary tunnel container. At the last process, the capillary tunnel container is charged with a predetermined amount of bi-phase condensative working fluid with respect to a content volume of the capillary tunnel container, obtaining the ribbon-like tunnel-plate type heat pipe.

The first fundamental method of manufacturing the ribbon-like tunnel-plate type heat pipes produces the following effects:

1) The ribbon-like tube can be formed out of a bullet through a single process of extrusion molding without any other processes such as process of extrusion of a large-diameter hollow tube, process of elongation of the hollow tube, process of machining of a plate, process of formation of a serpentine groove, and process of laminating of plates. Omission of the process of formation of a serpentine groove and process of laminating of plates which need a high technique and a high-priced equipment contributes to a reduction in material cost.

2) By way of example, the ribbon-like tube 1.9 mm in thickness and 20 mm in width has 20 capillary parallel tunnels of 1.0 mm diameter, so that the ribbon-like tunnel-plate heat pipe shows a performance equivalent to the serpentine capillary heat pipe having 20 serpentine capillary tubes of 1.0 mm inner diameter. Thus, when replacing the serpentine capillary heat pipe with the ribbon-like tunnel-plate heat pipe, a required cost can largely be reduced.

3) When arranged to wind between high and low temperature areas, the ribbon-like tunnel-plate heat pipe has a total number of turns equal to a product of the number of turns of the heat pipe itself and that of the serpentine capillary tunnel container formed therein, resulting in an improved performance. On the other hand, when formed with a plurality of capillary parallel container cells, and thus less number of turns, the heat pipe presents improved heat transport capacity. This produces a reduction in length of the heat pipe with respect to a target performance, resulting in a reduced manufacturing cost.

Referring to FIGS. 1–6, a first preferred embodiment of the present invention will be described. The first embodiment corresponds substantially to the first fundamental manufacturing method. FIG. 1 shows the first process wherein both ends of a ribbon-like tube 1 having a plurality of capillary parallel tunnels 3-n defined by a plurality of partitions 2-n are machined in a predetermined form. According to the first embodiment, both ends of the ribbon-like tube 1 are perpendicularly cut with respect to both sides thereof. Alternatively, both ends of the ribbon-like tube 1 may be cut to form an inclination or a curve. According to another method of manufacturing the ribbon-like tunnel-plate type heat pipes, machining of both ends of the ribbon-like tube enables formation of the capillary tunnel container. However, such machining should be carried out so as not to produce fins and close the capillary parallel tunnels, which constitutes a difficult work needing a lot of time. On the other hand, according to the method of the present invention, simple welding, compression, or solder filling with no additional machining is applicable to both ends of the ribbon-like tube 1 to form the capillary tunnel container, so that no consideration is necessary to be given to occurrence of the fins and closure of the capillary parallel tunnels 3-n.

Figure 2:
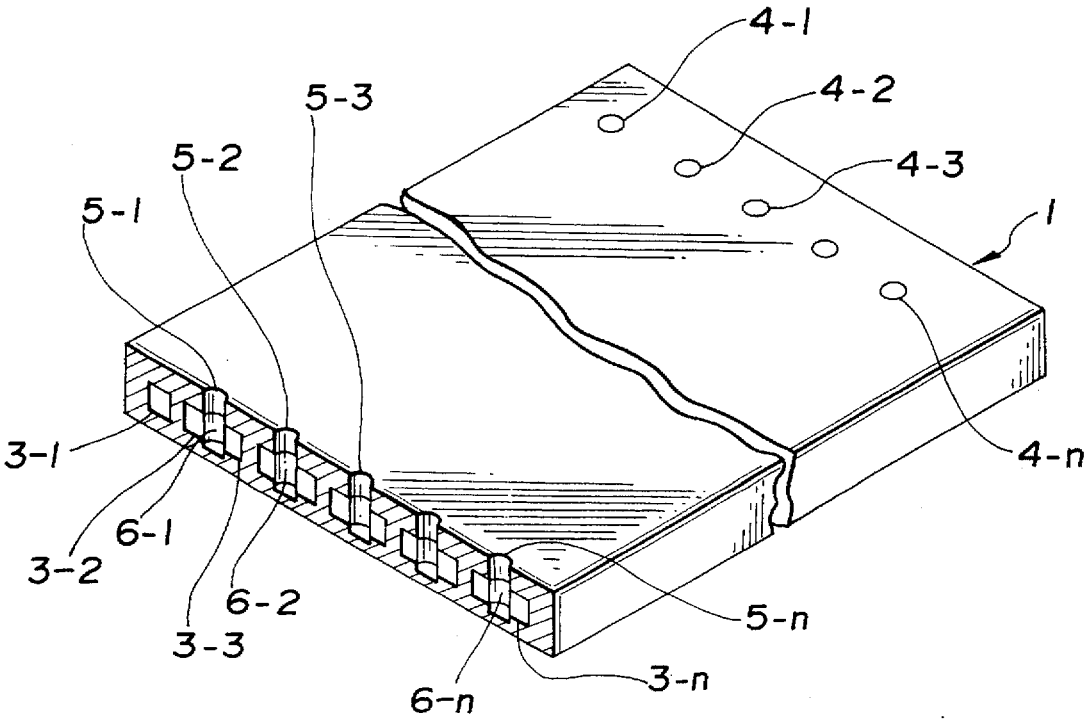
FIG. 2 is a view similar to FIG. 1, partly section, showing the ribbon-like tube after completing the second process.
Figure 3:
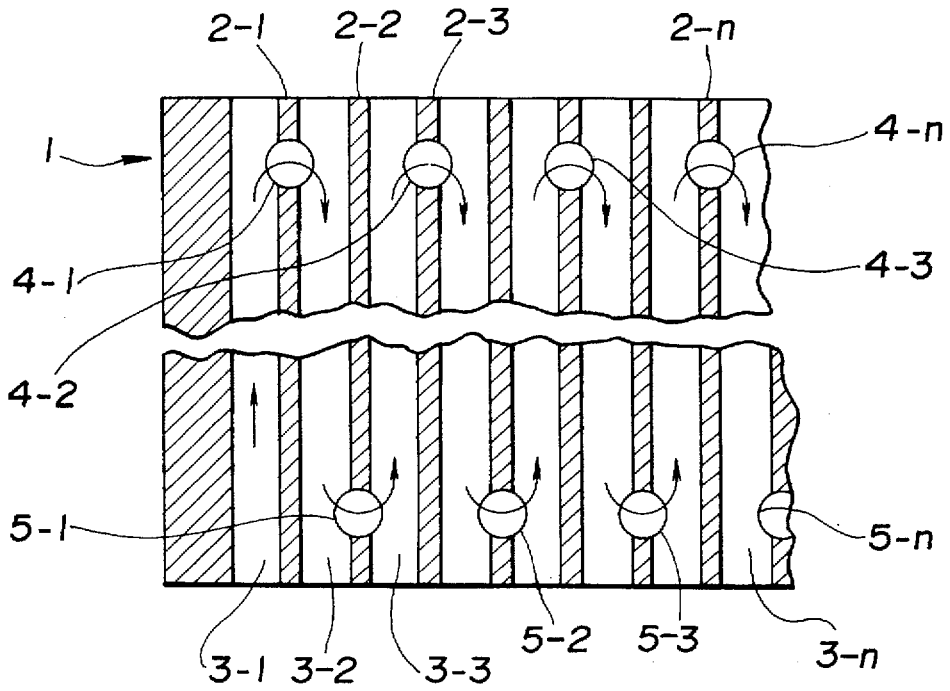
FIG. 3 is a sectional view showing the inside of the ribbon-like tube after completing the second process.

FIG. 2 shows the second process according to the first embodiment, whereas FIG. 3 shows the inside of the ribbon-like tube 1 after completing the second process. Referring to FIGS. 2 and 3, according to the first fundamental manufacturing method, at the second process, holes 4-n, 5-n having the diameter smaller than twice the diameter of the capillary parallel tunnel 3-n are formed from a surface of the ribbon-like tube 1 in respective positions slightly distant from respective ends of the ribbon-like tube 1 according to a machining method producing no fin such as electric discharge machining, ultrasonic machining, laser machining or the like, by which each partition 2-n between the capillary parallel tunnels 3-n is partly eliminated to ensure mutual communication of the capillary parallel tunnels 3-n at both ends thereof. On the other hand, according to the first embodiment, at the second process, the holes 4-n, 5-n are perpendicularly formed from one surface or both surfaces of the ribbon-like tube 1 in respective positions slightly distant from respective ends thereof by electric discharge machining. Electric discharge machining is the most efficient of the machinings of the fundamental manufacturing method. Specifically, a large number of holes can be formed simultaneously and through a single process by increasing the number of electrodes. Additionally, a light metal resulting from machining is in powder, and is dispersed in a liquid for electric discharge machining without producing any fin. Through formation of the holes 4-n, 5-n, the partitions 2-n each being arranged between the capillary parallel tunnels 3-n are partly alternately eliminated to have one partition eliminated portion or recess 6-n per partition, ensuring mutual communication of the capillary parallel tunnels 3-n at both ends thereof.

The third process, not shown, is such that the capillary parallel tunnels 3-n are cleaned to remove dirt and chip due to the above machining and perforating. Since the article to be cleaned or the ribbon-like tube 1 includes a large number of tunnels and holes, the third process is carried out, preferably, with ultrasonic cleaning for ensuring cleaning of the inside of the tunnels and holes.

Figure 4:
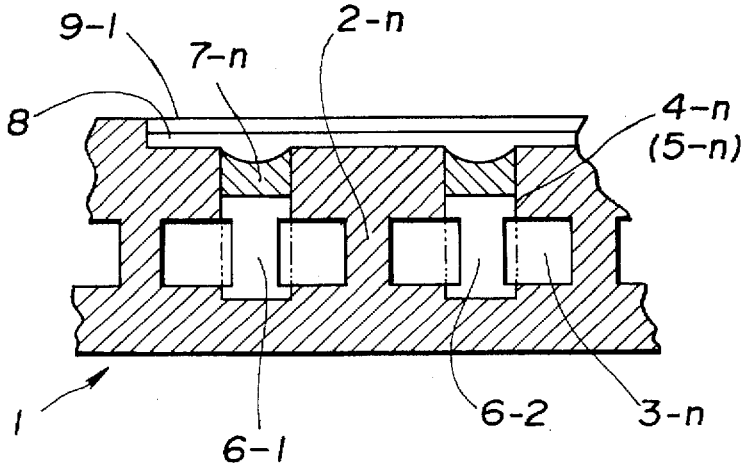
FIG. 4 is a cross section showing the ribbon-like tube after completing the fourth process.

FIG. 4 shows the ribbon-like tube 1 after completing the fourth process. The fourth process is such that openings of the holes 4-n, 5-n are closed by welding or soldering. Referring to FIG. 4, there are arranged the recesses 6-1, 6-2, which shows that the partitions 2-n are partly alternately eliminated by the holes 4-n, 5-n. The partitions 2-n are partly alternately eliminated in a position slightly distant from each end of the ribbon-like tube 1, so that the capillary parallel tunnels 3-n communicate with each other at both ends thereof to form a continuous serpentine capillary tunnel. The openings of the holes 4-n, 5-n are closed by fillers 7-n. The fillers 7-n should not be melted or decomposed at a welding or soldering temperature of the light metal. Thus, the fillers 7-n are applied which can resist a high temperature of, e.g. 900° C. without any change. Moreover, the fillers 7-n should be a material which is resistant to a flux used during welding or soldering at that high temperature. A solder 8 serves to join a light metal plate 9-1 on the surface of the ribbon-like tube 1 having the holes 4-n, 5-n to hermetically close the holes 4-n, 5-n. When the diameter of the holes 4-n, 5-n is very small, the openings of the holes 4-n, 5-n can be closed only by the solder 8 without using the light metal plate 9-1. Generally, the surface of the ribbon-like tube 1 should be smoothed after welding or soldering. According to the first embodiment, if the smoothness of the surface of the ribbon-like tube 1 is required, the fourth process is also carried out with surface smoothing means. Likewise, when the diameter of the holes 4-n, 5-n is very small, the fillers 7-n can be omitted. Moreover, the fillers 7-n can be replaced with means for closing the openings of the holes 4-n, 5-n, which apply compression of the surface of the ribbon-like tube 1.

Figure 5:
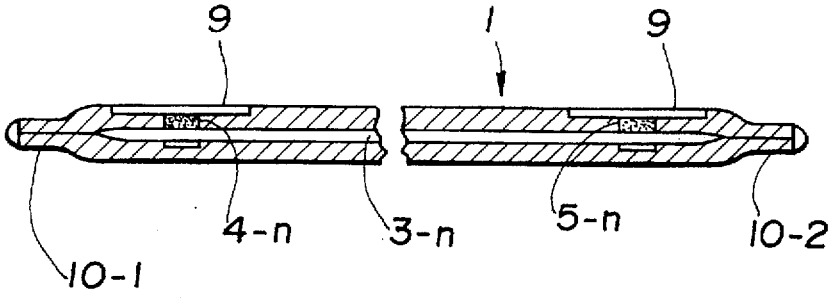
FIG. 5 is a longitudinal section showing the ribbon-like tube after completing the fifth process.

FIG. 5 shows the fifth process wherein both ends 10-1, 10-2 of the ribbon-like tube 1 are hermetically closed by welding or compression so that the capillary parallel tunnels 3-n form a capillary tunnel container. The capillary parallel tunnels 3-n which communicate with each other through the holes 4-n, 5-n constitute a continuous serpentine capillary tunnel container.

Figure 6:
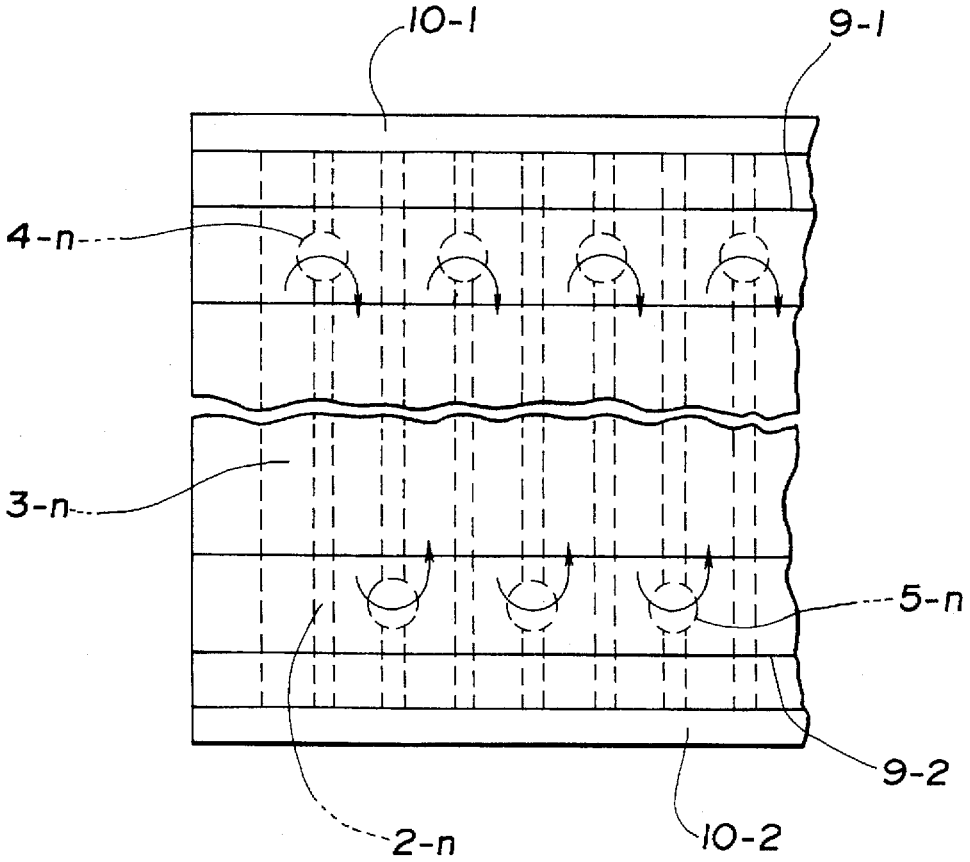
FIG. 6 is a plan view showing a ribbon-like tunnel-plate type heat pipe.

The capillary tunnel container obtained through the above five processes is charged with a predetermined amount of bi-phase condensative working fluid with respect to a content volume of the capillary tunnel container, obtaining a ribbon-like tunnel-plate type heat pipe as shown in FIG. 6. A hole for injecting working fluid is not shown in FIG. 6.

Figure 7:
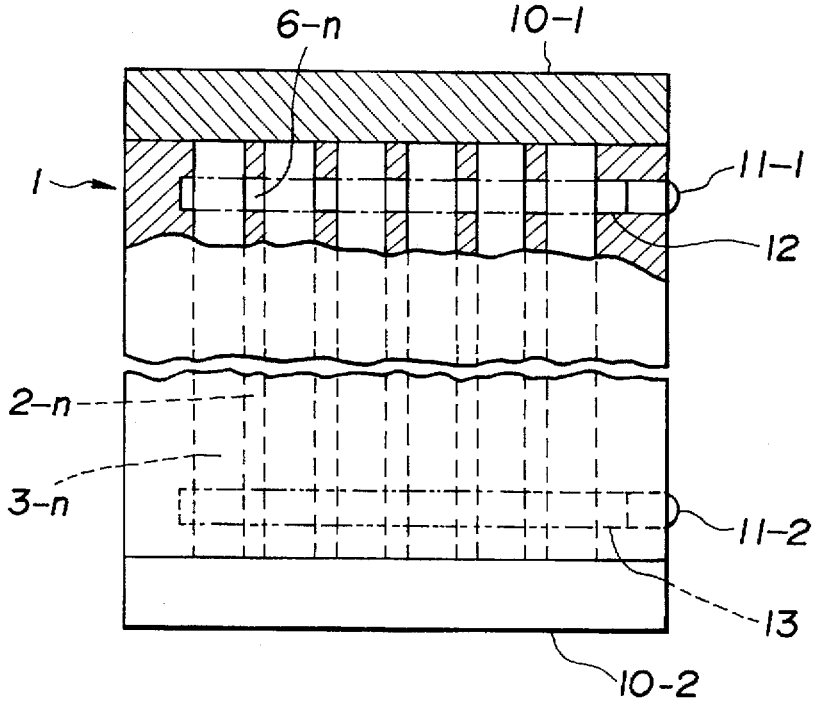
FIG. 7 is a view similar to FIG. 6, partly section, showing a second preferred embodiment of the present invention.

Referring to FIG. 7, a second preferred embodiment of the present invention will be described. The second embodiment is conceived to obtain out of the long ribbon-like tube 1 the long ribbon-like tunnel-plate type heat pipe arranged to wind between high and low temperature areas. According to the second embodiment, turns of the ribbon-like tunnel-plate type heat pipe are not fully ensured by arrangement of the recesses 6-n in the ribbon-like tube 1, but serpentine arrangement of the ribbon-like tube 1 itself. Holes 12, 13 are perpendicularly formed, by electric discharge machining, from one edge or both edges of the ribbon-like tube 1 which are parallel to the capillary parallel tunnels 3-n in respective positions slightly distant from both ends of the ribbon-like tube 1. The holes 12, 13 are formed to partly eliminate the partitions 2-n, and reach to the depth so that they meet all of the capillary parallel tunnels 3-n. Thus, the capillary parallel tunnels 3-n communicate with each other through the recesses 6-n in the vicinity of both ends thereof to serve as a nonserpentine capillary tunnel container. The tunnel-plate type heat pipe having a nonserpentine capillary tunnel container has a lower top heat characteristic than the tunnel-plate type heat pipe having a continuous serpentine capillary tunnel container, but a higher maximum heat transport capacity than the latter heat pipe due to arrangement of a plurality of parallel tunnel container cells.

Figure 8:
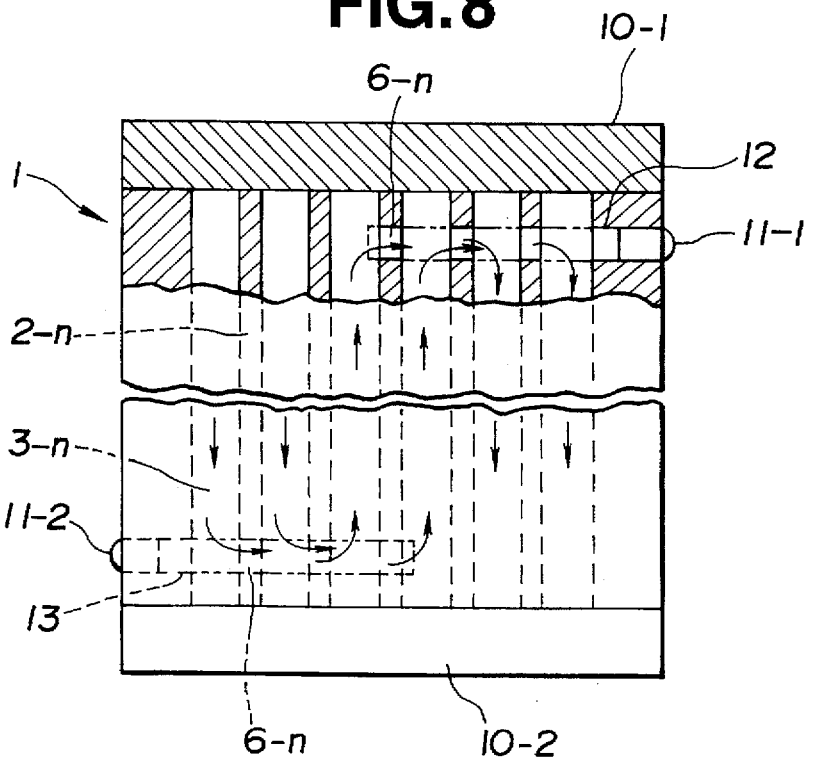
FIG. 8 is a view similar to FIG. 7, showing a third preferred embodiment of the present invention.

Referring to FIG. 8, a third preferred embodiment of the present invention will be described. The third embodiment is conceived to obtain the ribbon-like tunnel-plate type heat pipe having less number of capillary parallel tunnels 3-n and less number of turns. According to the third embodiment, at the second process, the holes 12, 13 are perpendicularly formed, by electric discharge machining, from one edge of the ribbon-like tube 1, respectively, in respective positions slightly distant from respective ends of the ribbon-like tube 1. The holes 12, 13 are formed to partly eliminate the partitions 2-n, and reach to the depth so that they meet ⅔ the capillary parallel tunnels 3-n. The holes 12, 13 are substantially symmetrically formed from the opposite edge of the ribbon-like tube 1 so that ⅓ the capillary parallel tunnels 3-n communicate with each other through the holes 12, 13 to constitute a serpentine capillary tunnel container having two turns in the ribbon-like tube 1. The tunnel-plate type heat pipe having such serpentine capillary tunnel container has less number of turns in the ribbon-like tube 1. However, when having a long size, and being arranged to wind between high and low temperature areas, the heat pipe has the number of turns substantially three times as many as that in the ribbon-like tube 1, showing a high performance. Compared with the first embodiment, the third embodiment has only two holes 12, 13, i.e. 1/10 or less the number of holes in the first embodiment, resulting in easy work and further reduced manufacturing cost.

On the other hand, a second fundamental method of manufacturing the ribbon-like tunnel-plate type heat pipes includes five processes: the first process wherein both ends of the ribbon-like tube having a thickness of 1 to 4 mm and a plurality of capillary parallel tunnels with a diameter of 3 mm or less are machined in a predetermined form; the second process wherein partitions each being arranged between the capillary parallel tunnels are partly eliminated, according to a machining method producing no fin such as electric discharge machining, ultrasonic machining, laser machining or the like, on every other partition or several partitions in a predetermined range from 3 to 10 mm from respective ends of the ribbon-like tube so as to obtain the recesses which are alternately arranged at both ends of the ribbon-like tube; the third process wherein the ribbon-like tube is crushed in end portions thereof corresponding to the depth of the recesses and having a predetermined length from the respective ends so as to hermetically close the capillary parallel tunnels, this crushing being carried out with non-crushed portions corresponding to 1 to 3 mm from the deepest position of the recesses; the fourth process wherein crushed ends of the ribbon-like tube are hermetically closed by welding or soldering so that the capillary parallel tunnels form a capillary tunnel container with excellent internal pressure resistance; and the fifth process wherein the capillary tunnel container is charged with a predetermined amount of bi-phase condensative working fluid with respect to a content volume of the capillary tunnel container, obtaining the ribbon-like tunnel-plate type heat pipe.

The most important of the above processes is the second process of part elimination of the partitions through which the capillary parallel tunnels form one or several serpentine capillary tunnel containers. The second most important is the third process of crushing of the end portions of the ribbon-like tube which enables prevention of a molten metal from penetrating into the capillary parallel tunnels when the crushed ends are closed by welding or soldering, and minimum arrangement of the above non-crushed portions, preventing a lowering of the function of the serpentine capillary tunnel container.

The second fundamental method of manufacturing the ribbon-like tunnel-plate type heat pipes produces the same effects as the first fundamental method.

Figure 9:
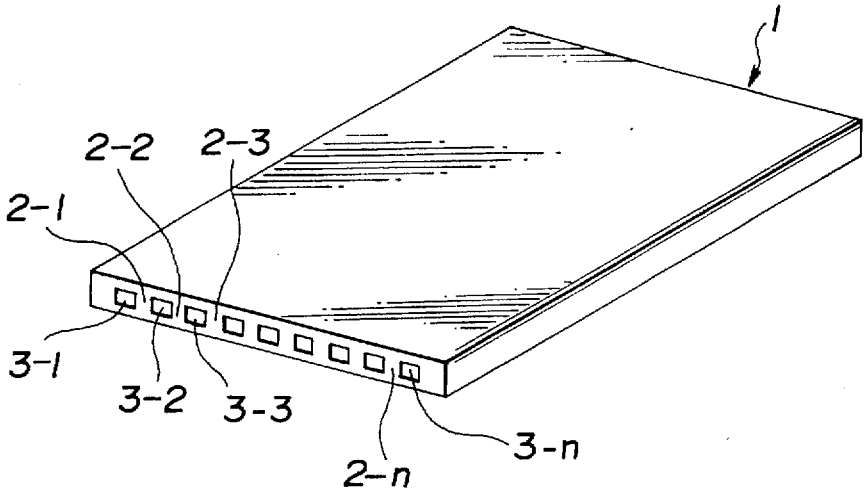
FIG. 9 is a view similar to FIG. 2, showing the ribbon-like tube after completing the first process according to a fourth preferred embodiment of the present invention.

Referring to FIGS. 9–12, a fourth preferred embodiment of the present invention will be described. The fourth embodiment corresponds substantially to the second fundamental manufacturing method. FIG. 9 shows the first process wherein both ends of the ribbon-like tube 1 having a plurality of capillary parallel tunnels 3-n defined by a plurality of partitions 2-n are machined in a predetermined form. According to the fourth embodiment, both ends of the ribbon-like tube 1 are perpendicularly cut with respect to both sides thereof. Alternatively, both ends of the ribbon-like tube 1 may be cut to form an inclination or a curve. Generally, such machining of the ribbon-like tube 1 made of a light and soft metal accompanies a difficult work of preventing occurrence of fins and deformation of openings of the capillary parallel tunnels 3-n, or removing the fins produced. According to the method of the present invention, both ends of the ribbon-like tube 1 does not require a plane accuracy as described later, so that no consideration is necessary to be given to occurrence of the fins and closure of the capillary parallel tunnels 3-n.

Figure 10:
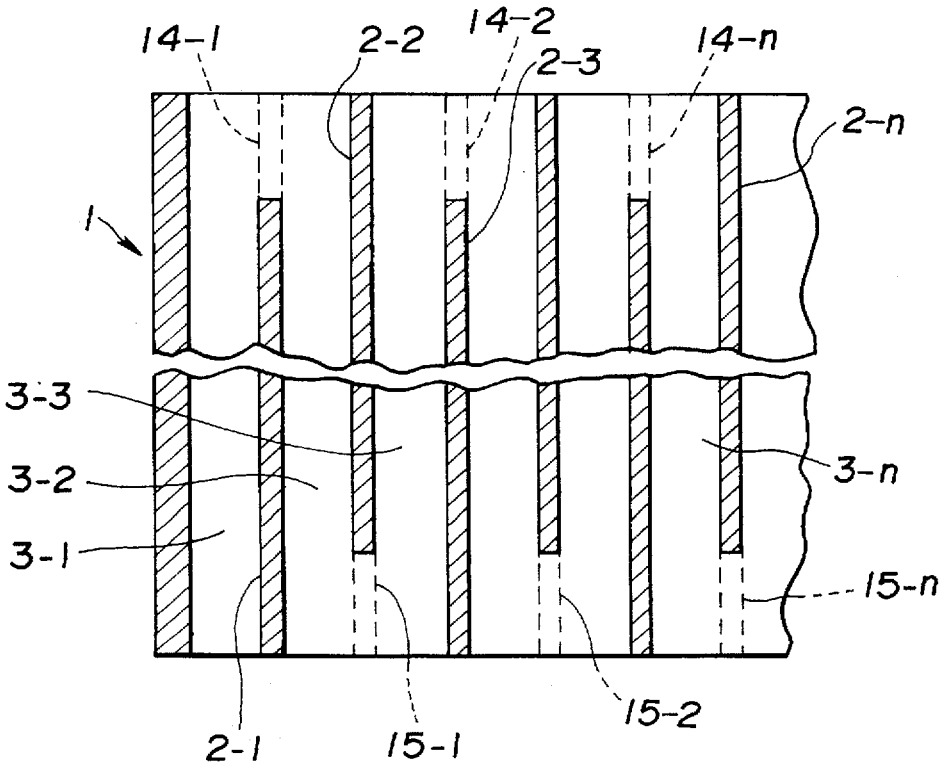
FIG. 10 is a view similar to FIG. 3, showing the ribbon-like tube after completing the second process.

FIG. 10 shows the inside of the ribbon-like tube 1 after completing the second process. The second process is such that the partitions 2-n each being arranged between the capillary parallel tunnels 3-n are partly eliminated on every other partition in a predetermined range from respective ends of the ribbon-like tube 1 so as to have one partition eliminated portion or recess 14-n, 15-n per partition. As a result, the recesses 14-n, 15-n are alternately arranged to ensure mutual communication of the capillary parallel tunnels 3-n at both ends of the ribbon-like tube 1.

According to the fourth embodiment, the partitions 2-n are partly eliminated on every other partition as shown in FIG. 10 to obtain a continuous serpentine capillary tunnel container. Alternatively, the partitions 2-n may partly be eliminated on every several partitions to obtain a plurality of capillary parallel container cells. The latter structure enables an increase in the amount of working fluid, resulting in tunnel-plate type heats pipe with higher maximum heat transport capacity.

Normally, the depth of the recesses 14-n, 15-n ranges from 3 mm or more to 10 mm or less from respective ends of the ribbon-like tube 1. This value is necessary with respect to closure of both ends of the ribbon-like tube 1 at the third process. However, if a space for holes for mounting the tunnel-plate type heat pipe, or a space for caulking after charging of working fluid is needed, the depth of the recesses 14-n, 15-n is increased to enlarge the area of crushed ends obtained at the third process. According to the present invention, the partitions 2-n are partly eliminated by a machining method producing no fin such as electric discharge machining, ultrasonic machining, laser machining or the like since occurrence of the fins degrades a performance and reliability of the tunnel-plate type heat pipe. Moreover, at the second process, the capillary parallel tunnels 3-n are cleaned to remove fine powder due to machining.

Figure 11:
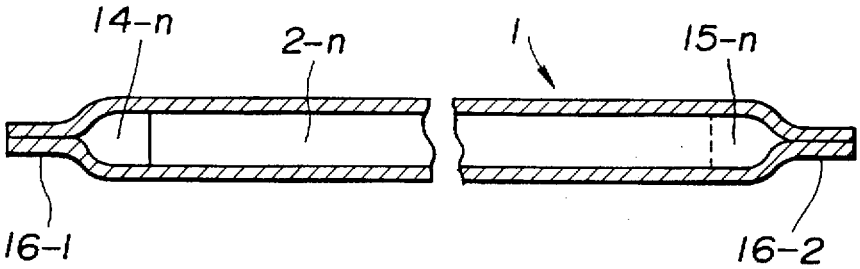
FIG. 11 is a view similar to FIG. 5, showing the ribbon-like tube after completing the third process.

FIG. 11 shows the ribbon-like tube 1 after completing the third process. The third process is a preparatory process for closing both ends of the ribbon-like tube 1. The ribbon-like tube 1 is crushed in end portions corresponding to the depth of the recesses 14-n, 15-n and having a predetermined length from the respective ends so as to hermetically close the capillary parallel tunnels 3-n, this crushing being carried out with crushed end portions 16-1, 16-2 and non-crushed portions corresponding to 1 to 3 mm from the deepest position of the recesses 14-n, 15-n. Crushing is the only method which has no possibility of closing the capillary parallel tunnels 3-n or the recesses 14-n, 15-n by a molten metal upon welding or soldering. Each non-crushed portion corresponds to a communicating portion between the adjacent two capillary parallel tunnels 3-n or a turn in the tunnel-plate type heat pipe. The theory and experiment reveal that the performance of the tunnel-plate type heat pipe is the most excellent when the length of the non-crushed portion is equal to the diameter or fluid diameter of the capillary parallel tunnel 3-n. Such reduced length of the non-crushed portion or the communicating portion cannot be obtained by any other method of closing the ends of the ribbon-like tube 1 due to its possible closure by a molten metal upon welding or soldering. According to the present invention, the length of the communicating portion, which is determined by that of the non-crushed portion, can be set to 1 to 3 mm, or equivalent to the fluid diameter of the capillary parallel tunnel 3-n.

Figure 12:
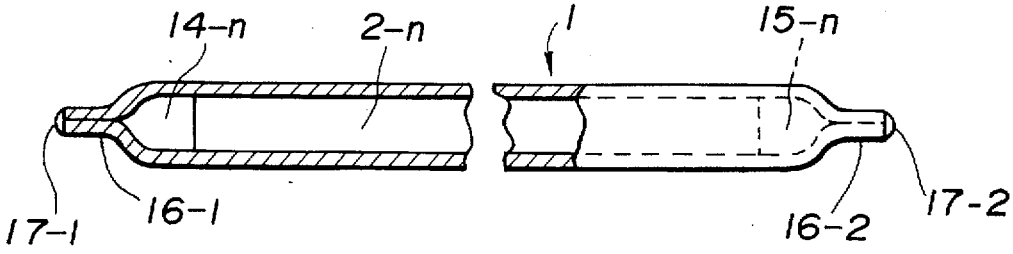
FIG. 12 is a side view, partly section, showing the ribbon-like tube after completing the fourth process.

FIG. 12 shows the ribbon-like tube 1 after completing the fourth process. The fourth process is such that the crushed ends of the ribbon-like tube 1 are hermetically closed by welding or soldering so that the capillary parallel tunnels 3-n form a serpentine capillary tunnel container. Welding or soldering of the crushed ends serves not only to hermetically close the ends of the ribbon-like tube 1 through welded or soldered portions 17-1, 17-2, but to integrally connect both faces of the crushed end portions 16-1, 16-2 through a molten metal penetrating into a clearance therebetween. The welded or soldered end portions of the ribbon-like tube 1 have an excellent airtightness, resulting in no necessity of a pressure proof test of the serpentine capillary tunnel container. Moreover, the welded or soldered end portions have a higher internal pressure strength, exceeding 150 $Kgf/cm^2$ when closing both ends of the ribbon-like tube 1 having, e.g. the thickness of 2 mm, the width of 20 mm, and 20 capillary parallel tunnels 3-n with 1.8 mm fluid diameter according to the fourth embodiment. Furthermore, the thickness of the welded or soldered end portions does not exceed that of the ribbon-like tube 1 itself, resulting in advantages such as easy insertion/contact of the tunnel-plate type heat pipe between/with heating units.

Figure 13:
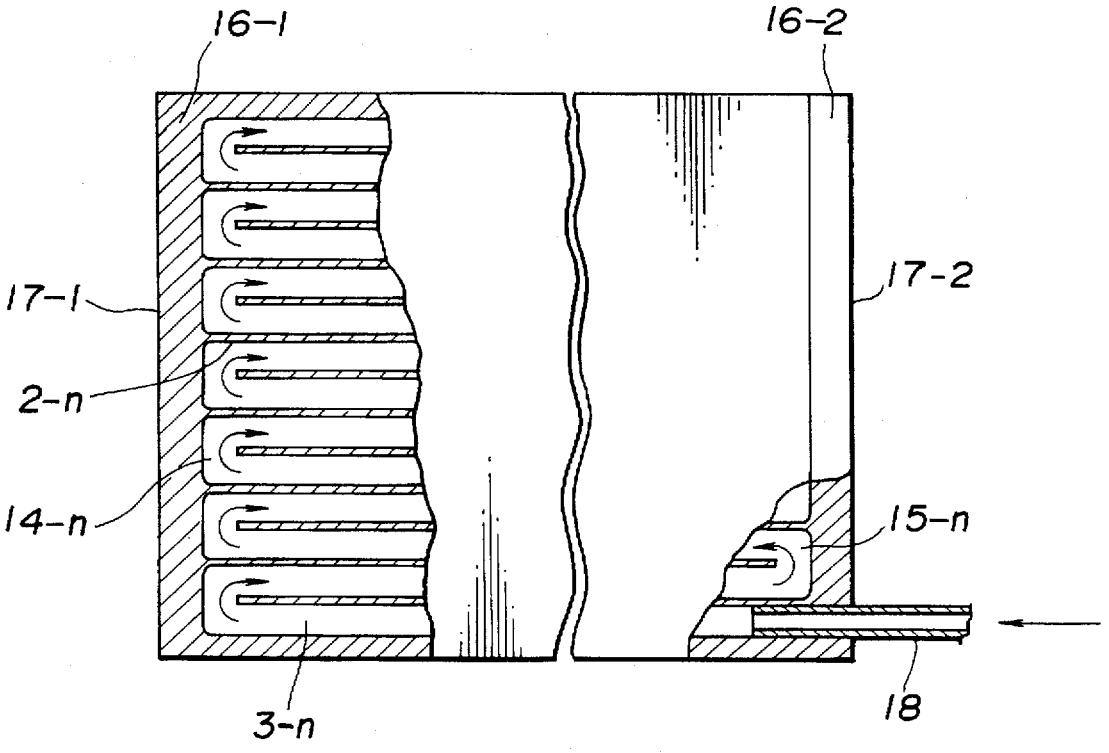
FIG. 13 is a view similar to FIG. 8, showing a fifth preferred embodiment of the present invention.

Referring to FIG. 13, a fifth preferred embodiment of the present invention will be described. In order to obtain the tunnel-plate type heat pipe, working fluid should be injected therein. For that purpose, a working fluid injecting tube 18 is connected to a predetermined end position of the ribbon-like tube 1 by welding or soldering so as to communicate with an end of the capillary parallel tunnel 3-n. Then, the end portions of the ribbon-like tube 1 is crushed in avoiding the predetermined end position of the ribbon-like tube 1, i.e. the working fluid injecting tube 18. When obtaining the looped tunnel-plate type heat pipe, both ends of the working fluid injecting tube 18 are connected to the outermost capillary parallel tunnels 3-n of the ribbon-like tube 1, respectively. FIG. 13 shows the tunnel-plate type heat pipe just before the fifth process. At the fifth process, the capillary tunnel container of the ribbon-like tube 1 is deaerated in the high-vacuum state, then charged with a predetermined amount of bi-phase condensative working fluid with respect to a content volume of the capillary tunnel container.

Having described the present invention in connection with the preferred embodiments, it is noted that the present invention is not limited thereto, and various changes and modifications can be made without departing from the spirit of the present invention.

What is claimed is:

1. A method of manufacturing a heat pipe out of a tube having capillary parallel tunnels defined by partitions, comprising the steps of:

shaping ends of the tube;

forming recesses in the partitions in the vicinity of each of said ends of the tube;

closing said ends of the tube to form a capillary tunnel container;

cleaning said capillary tunnel container; and charging said capillary tunnel container with a predetermined amount of a predetermined working fluid.

2. A method as claimed in claim 1, wherein said forming step is carried out according to a method producing no fin including electric discharge machining, ultrasonic machining, and laser machining.

3. A method as claimed in claim 2, wherein said forming step includes:

forming first holes from a surface of the tube, said first holes having the diameter smaller than twice the diameter of the capillary parallel tunnels; and closing openings of said first holes.

4. A method as claimed in claim 3, wherein said first holes are alternately formed at each of said ends of the tube.

5. A method as claimed in claim 3, wherein said openings closing step is carried out with a solder.

6. A method as claimed in claim 5, wherein said openings closing step is carried out further with means for reducing said openings of said first holes.

7. A method as claimed in claim 6, wherein said openings closing step is carried out further with a plate.

8. A method as claimed in claim 2, wherein said forming step includes forming two second holes from at least one edge of the tube, each of said two second holes communicating with all of the capillary parallel tunnels.

9. A method as claimed in claim 2, wherein said forming step includes forming two third holes from opposite edges of the tube, each of said two third holes communicating with ⅔ the capillary parallel tunnels.

10. A method as claimed in claim 1, wherein said recesses extend from 3 to 10 mm from said ends of the tube, respectively.

11. A method as claimed in claim 10, wherein said recesses are arranged on every other partition.

12. A method as claimed in claim 10, wherein said recesses are arranged on every several partitions.

13. A method as claimed in claim 1, wherein said closing step is carried out by one of welding, soldering, and crushing.

14. A method as claimed in claim 13, wherein said crushing is carried out with non-crushed portions corresponding to 1 to 3 mm from the deepest position of said recesses.

15. A method as claimed in claim 1, wherein said predetermined working fluid includes a bi-phase condensative fluid.

16. A method of manufacturing a heat pipe out of a tube having capillary parallel tunnels defined by partitions, comprising the steps of:

shaping ends of the tube;

forming recesses in the partitions in the vicinity of each of said ends of the tube, said forming step including forming first holes from a surface of the tube, said first holes having the diameter smaller than twice the diameter of the capillary parallel tunnels, and closing openings of said first holes;

closing said ends of the tube to form a capillary tunnel container;

cleaning said capillary tunnel container; and charging said capillary tunnel container with a predetermined amount of a predetermined working fluid.

17. A method as claimed in claim 16, wherein said forming step is carried out according to a method producing no fin including electric discharge machining, ultrasonic machining, and laser machining.

18. A method as claimed in claim 16, wherein said said first holes are alternately formed at each of said ends of the tube.

19. A method as claimed in claim 16, wherein said openings closing is carried out with a solder.

20. A method as claimed in claim 19, wherein said openings closing step is carried out further with means for reducing said openings of said holes.

21. A method as claimed in claim 20, wherein said openings closing step is carried out further with a plate.

22. A method as claimed in claim 17, wherein said forming step includes forming two second holes from at least one edge of the tube, each of said two second holes communicating with all of the capillary parallel tunnels.

23. A method as claimed in claim 17, wherein said forming step includes forming two third holes from opposite edges of the tube, each of said two third holes communicating with ⅔ the capillary parallel tunnels.

24. A method as claimed in claim 16, wherein said predetermined working fluid includes a bi-phase condensative fluid.

25. A method of manufacturing a heat pipe out of a tube having capillary parallel tunnels defined by partitions, comprising the steps of:

shaping ends of the tube;

forming recesses in the partitions in the vicinity of each of said ends of the tube;

crushing end portions of the tube;

closing said ends of the tube to form a capillary tunnel container;

cleaning said capillary tunnel container; and charging said capillary tunnel container with a predetermined amount of a predetermined working fluid.

26. A method as claimed in claim 25, wherein said recesses extend from 3 to 10 mm from said ends of the tube, respectively.

27. A method as claimed in claim 26, wherein said recesses are arranged on every other partition.

28. A method as claimed in claim 26, wherein said recesses are arranged on every several partitions.

29. A method as claimed in claim 25, wherein said crushing step is carried out with non-crushed portions corresponding to 1 to 3 mm from the deepest position of said recesses.

30. A method as claimed in claim 25, wherein said predetermined working fluid includes a bi-phase condensative fluid.

* * * * *

UNITED STATES PATENT AND TRADEMARK OFFICE

CERTIFICATE OF CORRECTION

PATENT NO. : 5,737,840
DATED : April 14, 1998
INVENTOR(S) : Hisateru AKACHI

It is certified that error appears in the above-identified patent and that said Letters Patent is hereby corrected as shown below:

Title page, item [56],
Under References Cited, please add the following:

Abstracts of Japan, vol. 009, no. 256 (M-421), October 15, 1985 (JP 60 106633 A)

Abstracts of Japan, vol. 012, No. 269 (M-723), July 27, 1988 (JP 63 049699 A)

Abstracts of Japan, vol. 010, no. 357 (M-540), December 2, 1986 (JP 61 153385 A)

Abstracts of Japan, vol. 014, no. 327 (M-0998), July 13, 1990 (JP 02 110296 A)

Abstracts of Japan, vol. 018, no. 034 (M-1544), January 19, 1994 (JP 05 264185 A)

Abstracts of Japan, vol. 006, no. 236 (M-173), November 25, 1982 (JP 57 136091 A)

Abstracts of Japan, vol. 011, no. 347 (M-641), November 13, 1987 (JP 62 125294 A)

UNITED STATES PATENT AND TRADEMARK OFFICE

CERTIFICATE OF CORRECTION

PATENT NO. : 5,737,840

DATED : April 14, 1998

INVENTOR(S) : Hisateru Akachi

It is certified that error appears in the above-identified patent and that said Letters Patent is hereby corrected as shown below:

Abstracts of Japan, vol. 014, no. 404 (M-1018), August 31, 1990 (JP 02 154989 A)

Signed and Sealed this

Twentieth Day of October, 1998

*Attest:*

*Attesting Officer*

BRUCE LEHMAN

*Commissioner of Patents and Trademarks*